US007258123B2

(12) United States Patent
Silva

(10) Patent No.: US 7,258,123 B2
(45) **Date of Patent: *Aug. 21, 2007**

(54) CLAW CLIP HAIR FASTENER

(76) Inventor: David Alan Silva, 2314 LaFayette St., Santa Clara, CA (US) 95050

( * ) Notice: Subject to any disclaimer, the term of this patent is extended or adjusted under 35 U.S.C. 154(b) by 188 days.

This patent is subject to a terminal disclaimer.

(21) Appl. No.: 10/892,902

(22) Filed: Jul. 17, 2004

(65) Prior Publication Data

US 2004/0255969 A1 Dec. 23, 2004

Related U.S. Application Data

(63) Continuation-in-part of application No. 10/133,067, filed on Apr. 26, 2002, now abandoned.

(51) Int. Cl.
*A45D 8/20* (2006.01)
*A45D 8/12* (2006.01)

(52) U.S. Cl. ..... 132/277; 132/275

(58) Field of Classification Search ..... 132/273, 132/275, 277, 128, 64.1, 53–55; D28/39–41; 24/300, 301, 485, 510, 565; 2/323
See application file for complete search history.

(56) References Cited

U.S. PATENT DOCUMENTS

| | | | | | |
|---|---|---|---|---|---|
| 689,811 | A * | 12/1901 | Brownley | 24/332 |
| 1,373,619 | A * | 4/1921 | Kohn | 24/331 |
| 3,418,698 | A * | 12/1968 | Holcomb | 24/485 |
| 3,638,284 | A * | 2/1972 | Baker | 24/306 |
| 4,123,047 | A * | 10/1978 | Koht et al. | 269/238 |
| 6,098,636 | A * | 8/2000 | Curtiss et al. | 132/277 |
| 6,612,312 | B2 * | 9/2003 | Silva | 132/200 |
| 6,631,538 | B1 * | 10/2003 | Carr | 24/299 |
| 6,647,991 | B2 * | 11/2003 | Silva | 132/273 |
| 6,691,717 | B2 * | 2/2004 | Silva | 132/275 |
| 2004/0255968 | A1 * | 12/2004 | Silva | 132/277 |

* cited by examiner

*Primary Examiner*—Robyn Doan

(57) ABSTRACT

A multiple clip hair fastener that comprises three or more claw clips attached together by spacer bands. The spacer bands are substantially rigid and are attached to each clip in such a manner as to restrict the movement of each clip from moving out of alignment in at least one direction. The clips can move in an up and down direction and not a side by side direction; this allows each clip to be attached one at a time to the hair, while the other clips are kept up and out of the way, while continuing to stay in alignment.

3 Claims, 1 Drawing Sheet

CLAW CLIP HAIR FASTENER

This is a continuation-in-part to U.S. application Ser. No. 10/133,067 filed Apr. 26, 2002 now abandoned.

BACKGROUND OF THE INVENTION

1. Field of the Invention

The present invention and method relates to a claw clip hair fastener. More particularly three or more claw clips connected to each other in alignment and in spaced relation by a rigid spacer band.

2. Description of Prior Art

Many people like to put their hair up in various styles. One way to put the hair up is to clip a plurality of sections of hair and secure them with individual hair clips. This process is effective and stylish but it is difficult for a non-hairstylist to achieve, especially when trying to keep the clips in alignment. It is also a time consuming process.

SUMMARY OF THE PRESENT INVENTION

An object of the present invention is to provide an instrument, which is convenient, practical, and inexpensive for use in hair styling.

A further object is to provide an instrument that will keep a plurality of claw clips neatly aligned.

A further object is to provide a single instrument that will keep a plurality of hair sections neatly secured to a single device.

A further object is to provide such an instrument that can be used unassisted by the individual styling their hair, eliminating the expense of a professional stylist.

A further object is to provide an instrument that can be reused over and over again.

A further object is to provide an instrument that will quickly hold the user's hair up in a neatly secured style.

According to the preferred embodiment of the present invention, there is provided a multiple claw clip hair fastener comprising 3 or more claw clips attached and aligned in spaced relation by a substantially rigid spacer band. The clips are the "bulldog" type, wherein the gripping arms of the clips bend in a direction away from the clips pivot in a concave since.

According to the arrangement described above a first claw clip is secured to a section of hair. Other sections of hair are then secured to the other remaining claw clips. As you will see below the current invention keeps three or more clips aligned with somewhat restricted movement. Because all the claw clips are attached and aligned with each other, the hair sections remain in conveniently separate sections held by a single apparatus while the clips don't move out of alignment.

Accordingly a preferred embodiment is a plurality of spring loaded plastic claw clips attached. The clips are attached and aligned with rigid spacer bands attached between each. The spacer bands can be connected to each clips edge portion. The spacer bands may be removably snap-locked to each clip, or attached by latches, hinges, or ball and joint. The spacers may or may not be removably connected. Having them removably connected would enable the user to add or take away clips and spacer bars, depending on the length they desire. The spacer bands are substantially rigid and are attached to each clip in such a manner as to restrict the movement of each clip from substantially moving out of alignment in at least one direction or from substantially moving from the fixed direction they are facing in at least one direction. The clips can move out of alignment in either an up and down fashion or a side-by-side fashion depending on the direction the clips are facing; this enables the clips to be attached one at a time to the hair, while the other clips stay up and out of the way of the attaching process while continuing to keep the clips in alignment in at least one direction.

Other objects, features and advantages of the present invention will become apparent from the following description of the preferred embodiments given with reference to the accompanying drawings.

DETAILED DESCRIPTION OF THE PREFERRED EMBODIMENTS

Figure 1:
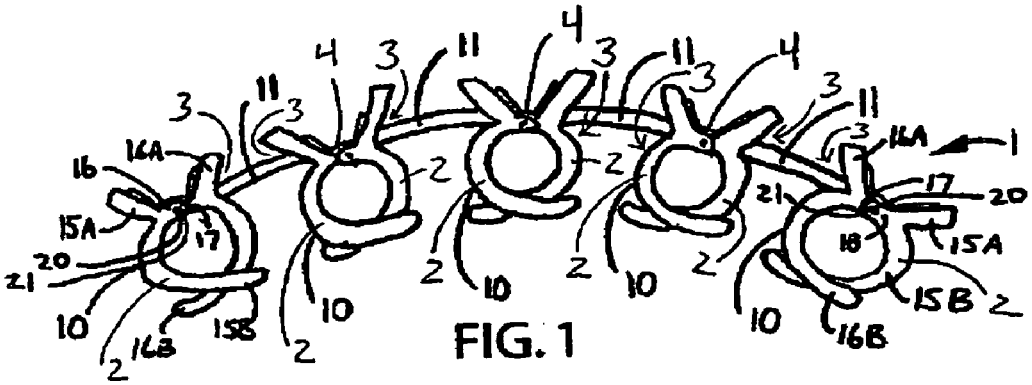
FIG. 1 is a plan view showing the multiple claw-clips attached to each other according to the present invention.
Figure 2:
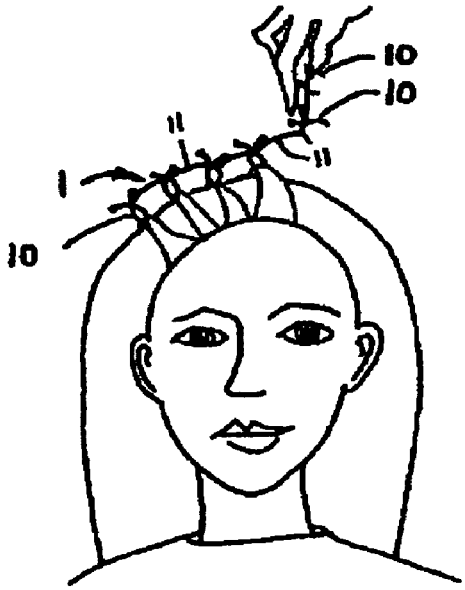
FIG. 2 is a schematic view showing the current invention being attached to the hair.

Referring to FIGS. 1 and 2 of the accompanying drawings. There is illustrated the multiple clip fastener embodying the present invention. The multiple clip hair fastener in a chain like configuration, generally designated by reference numeral 1, shows a plurality of attached clips 10. The clips 10 have an edge portion 3 with teeth 15*b* penetrating from edge portion 3 and a second edge portion 3 with teeth 16*b* penetrating from edge portion 3. The clips also have a pair of jaws 2 each includes a first ear portion 15*a* and a second ear portion 16*a*. Each ear portion 15, 16*a* has a pair of lugs 17, 18. The lugs 17,18 are aligned with a spring 19 intermediate them and a pin 20 is placed through holes 21 in lugs 17, 18. Wherein the first ear portion 15 is secure to the second ear portion 16*a*. Each clip 10 is attached to the next by a substantially rigid spacer band 11. Preferably the clip portions 10 and the spacer bands 11 are made of plastic.

Figure 3:
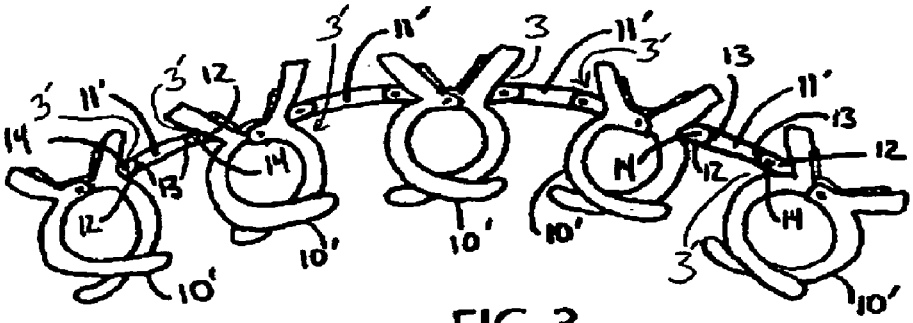
FIG. 3 is another embodiment of the current invention.

In use FIG. 2 of the multiple clip fastener 1 described above, the clips 10 are all attached to a different section of hair, one at a time. As you can see the clips can be bent up and out of the way of the clip that is being attached while the clips still stay in alignment. The hair sections could also be twisted before each clip is attached. The clips can bent up and out of the way because each lug 17 and 18 along with each pin 20 form a hinge 4. FIG. 3 shows the spacer bands 11' attached to the clips 10' by a hinge 12. Each spacer bands 11' have lugs 12 for mating with lugs 13 on each clip 10'. They are held in place by a pin 14.

The present invention being thus described any way to use the current invention should apply. Such variations are not to be regarded as a departure from the spirit and scope of the invention, and all such variations as would be obvious to those skilled in the art are intended to be included within the scope of the claims.

The invention claimed is:

1. A multiple clip hair fastener in a chain configuration comprising: a plurality of substantially rigid spacer bands and three or more claw clips pivotally attached to each other by said spacer bands whereby said chain includes a clip at each end and at least one intermediate clip located between said end clips; each of said clips comprising a pair of jaws having a mutual pivotal connection, each of said jaws having an edge portion spaced from said pivotal connection, said edge portion being formed with mutually engaging gripping teeth; said edge portion and said gripping teeth being bent in a concave sense in a direction away from said pivotal connection; each of said clips further comprise spring means which urges said edge portion of said jaws together and said gripping teeth into mutual engagement; each of said clips further comprises a pair of ears disposed on the side of said spring means remote from said jaws, each of said end clips is attached to said rigid spacer bands by a hinge located at a junction of said ears and said jaws and each of said at least one intermediate clip is attached to said rigid spacer bands by two hinges, each of said hinges located at a junction of said ears and said jaws; wherein said spacer bands being attached to each of said clips in such a manner as to restrict each of said clips from substantially moving out of alignment in at least one direction; such that said clips can substantially move in an up and down direction and not a side to side direction; whereby each of said clips can be attached one at a time to the hair, while the unattached clips can be up and out of the way while continuing to stay in alignment in said at least one direction.

2. The multiple clip hair fastener of claim 1 wherein each said spacer bands are removably attached.

3. A method of securing and styling hair comprising the steps of:

Selecting a multiple clip hair fastener in a chain configuration, wherein said multiple clip hair fastener comprising a plurality of substantially rigid spacer bands and three or more claw clips pivotally attached to each other by said spacer bands whereby said chain includes a clip at each end and at least one intermediate clip located between said end clips; each of said clips comprising a pair of jaws having a mutual pivotal connection, each of said jaws having an edge portion spaced from said pivotal connection, said edge portion being formed with mutually engaging gripping teeth; said edge portion and said gripping teeth being bent in a concave sense in a direction away from said pivotal connection; each of said clips further comprise spring means which urges said edge portion of said jaws together and said gripping teeth into mutual engagement; each of said clips further comprises a pair of ears disposed on the side of said spring means remote from said jaws, each of said end clips is attached to said rigid spacer bands by a hinge located at a junction of said ears and said jaws and each of said at least one intermediate clip is attached to said rigid spacer bands by two hinges, each of said hinges located at a junction of said ears and said jaws; wherein said spacer bands being attached to each of said clips in such a manner as to restrict each of said clips from substantially moving out of alignment in at least one direction; such that said clips can substantially move in an up and down direction and not a side to side direction; whereby each of said clips can be attached one at a time to the hair, while the unattached clips can be up and out of the way while continuing to stay in alignment in said at least one direction, Clamping each of said claw clip to a section of hair and continuing in the same manner until all said claw clips are secured to a section of hair.

* * * * *